US009938063B2

(12) United States Patent
Mark et al.

(10) Patent No.: US 9,938,063 B2
(45) **Date of Patent: *Apr. 10, 2018**

(54) PACKAGE FOR STORING A PLURALITY OF PRODUCTS

(71) Applicant: The Gillette Company LLC, Boston, MA (US)

(72) Inventors: Erwin Paul Mark, Eschborn (DE); Craig Wilburn, West Chester, OH (US); Martin Jay Marotti, Carmel, IN (US); Oliver Horst Heilmann, Bad Soden (DE); Harald De Buhr, Frankfurt (DE); Eric Latza, Schwalbach (DE); Christian Stief, Frankfurt (DE)

(73) Assignee: THE GILLETTE COMPANY LLC, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/223,808

(22) Filed: Jul. 29, 2016

(65) Prior Publication Data

US 2017/0029186 A1 Feb. 2, 2017

(30) Foreign Application Priority Data

| | | |
|---|---|---|
| Jul. 29, 2015 | (EP) | 15178783 |
| Apr. 20, 2016 | (EP) | 16166140 |
| Apr. 20, 2016 | (EP) | 16166141 |

(51) Int. Cl.
*B65D 71/46* (2006.01)
*B65D 73/00* (2006.01)
(Continued)

(52) U.S. Cl.
CPC ..... *B65D 71/46* (2013.01); *A46B 15/0093* (2013.01); *B65B 47/02* (2013.01); *B65D 73/0092* (2013.01); *B65D 75/366* (2013.01)

(58) Field of Classification Search
CPC ..... A46B 15/00; A46B 15/0093; B65B 47/02; B65D 71/46; B65D 71/50; B65D 73/00;
(Continued)

(56) References Cited

U.S. PATENT DOCUMENTS

| | | | |
|---|---|---|---|
| 2,993,590 | A | 7/1961 | Denton |
| 3,220,543 | A | 11/1965 | McCord et al. |

(Continued)

FOREIGN PATENT DOCUMENTS

| | | |
|---|---|---|
| CN | 202987849 | 6/2013 |
| DE | 9102473 | 5/1991 |

(Continued)

OTHER PUBLICATIONS

European Search Report dated May 11, 2016, 5 pages.
U.S. Appl. No. 15/223,905, filed Jul. 29, 2016, Erwin Paul Mark et al.

*Primary Examiner* — Bryon Gehman
(74) *Attorney, Agent, or Firm* — Vladimir Vitenberg

(57) ABSTRACT

A package kit includes a plurality of primary packages, each having a cavity for storing one of a plurality of products, and a secondary package that stores the plurality of primary packages and includes a back and front panels between which the primary packages are sandwiched. The front panel has a first row of apertures, each displaying at least a portion of a primary package. A first outer circumferential portion of the front panel partially surrounds the apertures and is attached to the back panel, and a second outer circumferential portion of the front panel is attached to the back panel. The front panel includes an elevated portion between the first and second outer circumferential portions. The first
(Continued)

outer circumferential portion has a first and second limbs, and the second outer circumferential portion has a third and fourth limbs. The elevated portion extends from, and is hingeably connected to, the first, second, third, and fourth limbs.

14 Claims, 3 Drawing Sheets

(51) Int. Cl.
*A46B 15/00* (2006.01)
*B65B 47/02* (2006.01)
*B65D 75/36* (2006.01)

(58) Field of Classification Search
CPC ..... B65D 73/0021; B65D 73/0092; B65D 75/36; B65D 75/366; B65D 75/367; B65D 75/52; B65D 75/527; B65D 77/26; B65D 85/20–85/28
USPC ..... 206/362.1–362.3, 369, 372, 380–382, 206/485, 526
See application file for complete search history.

(56) References Cited

U.S. PATENT DOCUMENTS 3,948,391 A * 4/1976 Beaman ..... B65D 75/366 206/382
5,414,890 A 5/1995 Morando
5,428,940 A * 7/1995 Paumen ..... B65D 71/16 206/705
5,544,755 A 8/1996 Paumen et al.
6,397,860 B1 6/2002 Hill, II
6,726,011 B2 4/2004 Sarkar et al.
7,325,686 B2 * 2/2008 Aldridge ..... B65D 71/0085 206/460
7,424,952 B2 9/2008 Antler
7,866,477 B2 1/2011 Sturm et al.
8,033,287 B2 10/2011 Cullup
8,066,178 B2 11/2011 Sorrentino et al.
8,393,469 B2 * 3/2013 Aldridge ..... B65D 77/02 206/460
8,511,467 B2 8/2013 Sorrentino et al.
8,528,806 B2 9/2013 Sorrentino et al.
9,033,150 B2 * 5/2015 Andrich ..... B65D 25/54 206/378
2003/0024848 A1 2/2003 Oycke
2010/0300926 A1 * 12/2010 Specker ..... B65D 5/504 206/564
2012/0205276 A1 8/2012 Shackford
2013/0313155 A1 11/2013 Ha et al.

FOREIGN PATENT DOCUMENTS

FR 2276801 1/1976
JP 2001253475 A * 9/2001
JP 2004081656 3/2004
JP 200300350 7/2004
JP 2008150062 7/2008
KR 200390038 11/2003
WO WO9517116 6/1995
WO WO9722528 6/1997
WO WO2004043203 5/2004

* cited by examiner

PACKAGE FOR STORING A PLURALITY OF PRODUCTS

FIELD OF THE INVENTION

The present disclosure is concerned with a package kit comprising a primary package for storing a plurality of products, and a secondary package. The present disclosure is further concerned with a package-product arrangement comprising such package kit and a plurality of products, and a process for the manufacture of such package-product arrangement.

BACKGROUND OF THE INVENTION

Packages for storing and providing a plurality of products for sale, like disposable consumer products, are well known in the art. In the following, such packages are referred to as "multipacks".

Consumer products, for example personal hygiene products, like oral care implements, are commonly packaged for sale in blister multipacks. These multipacks typically comprise a blister layer having a plurality of blister cavities in which the products are stored. The blister layer is usually attached to a cardboard blank. If a consumer wants to take one of the products out of the multipack, he will remove the blister layer from the cardboard blank to some extent, thereby partially destroying the package. Consequently, the products remaining in the multipack are not completely sealed by the blister layer anymore. Since the products are not properly sealed in a hygienic manner after opening the multipack, there is a risk for contamination. In addition, the partial destruction of the package renders the overall appearance of the package less attractive. Furthermore, such blister multipacks do not provide sufficient space for printing information and/or artwork on the front side of the package.

Further, another type of multipack is known in the art for packing batteries and other elongated consumer products. Such multipack is made of a single material, preferably being biodegradable, e.g. cardboard material, in which elongated articles can be held reliably in a desired orientation, for example with a trademark facing forwards. A sheet of cardboard is folded about parallel lines to form a channel with a pair of aligned openings in opposite integral limbs of the channel to receive and fit closely about the side of end regions of the packed article inserted in the openings. End locating regions are provided for retaining the article in the openings. The limbs are taut, thereby frictionally gripping and preventing rotation of the article.

While this type of package provides an environmentally desirable solution for storing and selling a plurality of articles, it is not as well suited to provide a hygienic storing solution of the remaining articles once the package has been opened. Here again, the appearance of the package is less attractive once the package is opened and one article is removed.

It is an object of the present disclosure to provide a package for storing a plurality of products, which is easy to handle, in particular easy to open, and which package hygienically protects remaining products once the package has been opened to remove one of the products from the package. Further, products remaining in the package shall be provided in an appealing/attractive way. Additionally, the package should provide sufficient space for printing/displaying information and/or artwork.

SUMMARY OF THE INVENTION

In accordance with one aspect, a package kit for storing a plurality of products is provided, the package kit comprising:

a plurality of primary packages, each primary package comprising a cavity for storing one of the products, and a secondary package storing the plurality of primary packages, the secondary package comprising a back panel and a front panel, the plurality of primary packages being sandwiched between the back panel and the front panel, the front panel comprising at least a first row of a plurality of apertures, the number of apertures corresponding to the number of primary packages for displaying at least a portion of each primary package, at least a first outer circumferential portion partially surrounding the plurality of apertures and being at least partially attached to the back panel, and a second outer circumferential portion being at least partially attached to the back panel, wherein the front panel further comprises an elevated portion being arranged between the first and the second outer circumferential portion, wherein the first outer circumferential portion comprises a first limb and a second limb, and the second outer circumferential portion comprises a third limb and a fourth limb, and the elevated portion extends from the first, the second, the third and the fourth limb, respectively, wherein the elevated portion is hingeably connected to the first, the second, the third and the fourth limb, respectively.

In accordance with one aspect, a package-product arrangement is provided that comprises such package kit and a plurality of products.

In accordance with one aspect, a process for the manufacture of a package-product arrangement is provided. The process comprises the following steps:

providing a plurality of plastic sheets, inserting the plastic sheets into molds, each mold having a mold cavity, heating the plastic sheets to a forming temperature in order to be pliable, thermoforming a cavity into each plastic sheet, the cavity corresponding to the shape of the mold cavity, thereby providing a blister layer comprising a blister cavity, providing a plurality of products, inserting the products into the respective blister cavities, providing a plurality of cardboard blanks, attaching the cardboard blanks onto the blister layers, thereby providing a plurality of primary packages, each package comprising a product, providing a front panel in a substantially flat manner, the front panel comprising at least a first row of a plurality of apertures, the number of apertures corresponding to the number of primary packages, at least a first outer circumferential portion partially surrounding the plurality of apertures, a second outer circumferential portion, and a portion being arranged between the first and the second outer circumferential portion, folding the front panel in a manner that the portion is elevated with respect to the first and second outer circumferential portions, and forms an inner recess, laying the primary packages onto the front panel so that the blister cavities are placed in the recess, and each cavity extend at least partially through the respective aperture, providing a back panel, and attaching the back panel to at least a portion of the first outer circumferential portion and to at least a portion of the second outer circumferential portion, thereby providing a secondary package comprising a plurality of primary packages and the products.

In accordance with one aspect, a package-product arrangement obtainable or obtained by said process is provided.

BRIEF DESCRIPTION OF THE DRAWINGS

The invention is described in more detail below with reference to various embodiments and figures, wherein.

DETAILED DESCRIPTION OF THE INVENTION

Figure 1:
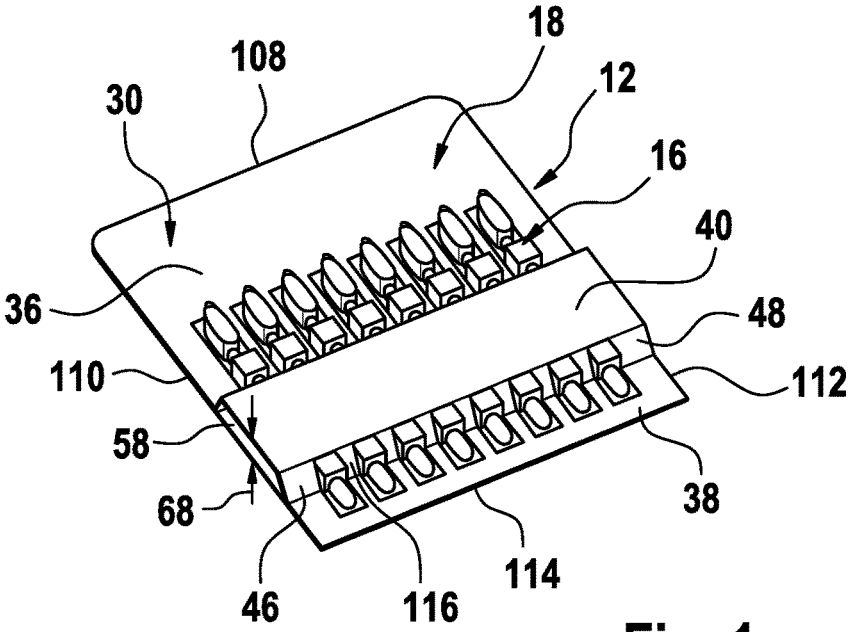
FIG. 1 shows a schematic perspective view of an embodiment of a package kit comprising a primary and a secondary package.

A package kit in accordance with the present disclosure comprises a plurality of inner primary packages and an outer secondary package, i.e. the primary packages are stored/provided in the outer secondary package. Each primary package comprises an individually sealed cavity for individually storing a product. For example, the products may be disposable consumer products, e.g. oral care implements, in particular toothbrushes.

The primary packages are packed in the secondary package. The secondary package comprises a back panel and a front panel between which the primary packages are sandwiched and stored.

The front panel comprises at least a first row of a plurality of apertures. The number of apertures corresponds to the number of primary packages being stored in the secondary package. At least a portion of each primary package is visible through a respective aperture. The apertures may be cut-out windows which may be covered, for example, by a transparent foil, or, alternatively the apertures/windows may be uncovered.

The front panel further comprises at least a first outer circumferential portion which partially surrounds the plurality of apertures, and a second outer circumferential portion. Both, the first and the second outer circumferential portions are at least partially attached to the back panel to keep the secondary package in a closed position. For example, the back panel may be attached/connected to the front panel by means of hot or cold sealing, adhesive tape application, adhesive and/or glue. At least a part of the outer circumferential portion of each primary package may be placed between a portion of the first and the second outer circumferential portion of the front panel and the pack panel, respectively, to retain the primary packages between the front and the back panel of the secondary package.

The package kit may be shaped as a square or rectangle—when seen in a top down view—having four lateral edges, i.e. an upper and a lower lateral edge along the width extension of the package kit, and two opposed lateral edges along the length extension of the package kit. Further, the apertures may also be shaped as a square or rectangle to display at least a portion of the products. For example, the first circumferential portion of the front panel may be arranged along the upper lateral edge and along a portion of both lateral edges along the length extension of the package kit, while the second circumferential portion may be arranged along the lower lateral edge and along a portion of both lateral edges along the length extension of the package kit.

Moreover, the front panel comprises an elevated portion being arranged between the first and the second outer circumferential portions. The term "elevated portion" refers to a portion being more elevated than any other portion of the secondary package when the package is seen in a side view. The elevated portion may extend from both, the first outer circumferential portion and the second outer circumferential portion and forms a boundary of the apertures of the at least first row. The elevated portion may extend between the two opposed lateral edges of the secondary package in a substantially perpendicular or angled manner. The elevated portion may provide the package kit with improved stability properties, thereby protecting the products stored therein from getting damaged during shipping, distribution and sale. Furthermore, the elevated portion may provide space for printing/displaying artwork and/or information pertaining to the products stored within the package kit.

Between two neighboring apertures a web may be provided. Each web may extend between the first outer circumferential portion and the elevated portion. The webs may provide the package kit with even more stability, while the apertures display the primary packages/products stored therein.

The first outer circumferential portion comprises a first limb and a second limb, and the second outer circumferential portion comprises a third limb and a fourth limb. The elevated portion extends from the first, the second, the third and the fourth limb, respectively. The first, the second, the third and the fourth limb may be arranged at the lateral edges along the length extension of the package kit, respectively. The first, second, third and fourth limb may extend from the first and second outer circumferential portions in a substantially perpendicular or angled manner in a direction away from the back panel. In other words, between two opposite limbs arranged at one lateral edge, there is a region where the front panel is not attached to the back panel. Instead, the front panel is elevated and forms the elevated portion. Between the upper surface of the back panel and the lower surface of the elevated portion of the front panel, a clearance/cutout may be provided which may serve as a gripping aid and which may facilitate handling and gripping the package kit. A consumer may place his/her fingers into the clearance/cutout for easy picking and handling of the package kit.

The elevated portion is hingeably connected to the first, second, third and fourth limbs. Additionally, the first and the second limbs may be hingeably connected to the first outer circumferential portion, and the third and the fourth limbs may be hingeably connected to the second outer circumferential portion. Such hingeable connection may be provided by means of a crease, a perforation or a folding line. In other words, the elevated portion extends from the limbs in a hingeable manner. Further, each of the limbs may extend from the respective outer circumferential portions in a hingeable manner, as well. This may allow the elevated portion to move/bend slightly in opposite directions, i.e. some flexibility is given to the elevated portion. In case pressure is applied onto the upper surface of the elevated portion from a direction not perpendicular to said upper surface, the elevated portion may slightly move/bend in the direction of pressure avoiding damage to the elevated portion.

Further, such hingeable connection between the limbs and the outer circumferential portions, and the elevated portion and the limbs, respectively, may allow the front panel to be provided in a substantially flat manner before connecting/attaching the front panel to the back panel in a process for manufacturing a package kit or a package-product arrangement.

A package-product arrangement according to the present disclosure comprises a package kit and a plurality of products. At least one of said products may be an oral care implement, for example a manual toothbrush or a refill for an electrical toothbrush. The package-product arrangement may comprise a package kit storing eight, seven, six or less individually sealed oral care implements. However, the package-product arrangement may also comprise more than eight individually sealed oral care implements, for example nine or ten or even more individually sealed oral care implements.

In case a consumer wants to remove a product from the package-product arrangement, he may detach the back panel from the front panel thereby opening the secondary package. The secondary package may be discarded. A desired number of products may be taken from the package kit without damaging the remaining primary packages. Therefore, the remaining cavities remain sealed and the products stored therein are protected against contamination. Further, the overall appearance of the remainder of primary packages stays aesthetically appealing since the primary packages remain undamaged.

The back panel of the secondary package may comprise at least one perforation zone, e.g. a perforation line to facilitate opening the secondary package by tearing/cutting along said perforation.

The front panel may further comprise a second row of a plurality of apertures and the number of apertures may correspond to the number of primary packages for displaying at least a further portion of each primary package. The second outer circumferential portion may partially surround the plurality of apertures of the second row. In other words, the elevated portion may be arranged between the first row of apertures and the second row of apertures and may form a boundary thereof. Further, the elevated portion may extend from the first and the second outer circumferential portions. Between two neighboring apertures of the second row a web may be provided. Each web may extend between the second outer circumferential portion and the elevated portion. The webs may provide the package kit with even more stability while the apertures display the primary packages/products stored therein.

Front and/or the back panel may be unitarily formed from a cardboard blank. In case the secondary package is at least partially made of cardboard material being substantially recyclable, an environmentally sustainable package may be provided. The cardboard blank may be a single- or multi-layer cardboard. The cardboard blank may have a weight, i.e. a surface weight of from about 250 g/m$^2$ to about 600 g/m$^2$, optionally of from about 300 g/m$^2$ to about 500 g/m$^2$, further optionally of about 400 g/m$^2$. A package having a cardboard weight of about 400 g/m$^2$ may provide sufficient stability to the package while the cardboard can still be folded easily along hinges, creases or folding lines. Flapping/turning hinged limbs and/or hinged elevated portions into the required positions during manufacturing processes may be performed in a relatively facile manner.

The front panel and the back panel of the secondary package may be unitarily formed from a cardboard blank, i.e. the secondary package is formed from one piece of cardboard blank which may be a single- or a multi-layer cardboard.

Alternatively, front and back panel may be formed from separate cardboard blanks, and the weight, i.e. the surface weight of the cardboard blank of the front panel may be equal to or different from the weight of the cardboard blank of the back panel, i.e. the weight of the cardboard blank of the front panel may be higher or lower than the weight of the cardboard blank of the back panel. Forming front and back panel from two separate cardboard blanks allows more flexibility with respect to package properties. For example, the back panel may have a lower weight, e.g. of from about 200 g/m$^2$ to about 250 g/m$^2$, to provide a lighter overall package. The front panel may have a higher weight than to the back panel, e.g. of from about 300 g/m$^2$ to about 400 g/m$^2$, to provide sufficient stability properties of the package kit. Further, the back panel may be provided with printings in a cost efficient manner, e.g. only in one color, or the back panel may be provided without any printings to provide a package at relatively low costs. Instead, artwork and/or information may be printed onto the front panel only, for example in the form of color prints comprising metallic effects.

The secondary package may comprise a flap hingeably connected to a lateral edge of the first or second outer circumferential portion of the front panel, and/or a flap may be hingeably connected to a lateral edge of the back panel. The flap may provide space for printing artwork and/or information, for example pertaining to properties of the products stored in the package kit. The hingeable connection may be provided by means of a crease, a perforation or a folding line. The hingeable connection may allow the flap to be turned upwards in an open position or downwards in a closed position, i.e. onto and in alignment with the front panel. In case artwork and/or information is printed onto the inner surface of the flap facing the upper surface of the front panel, information can be hidden from immediate visual inspection at the point of sale, for example by flapping the flap onto the front panel. Before a product is taken out of the package kit, the consumer may turn the flap in an open/upward position to read the respective information. The flap and the front panel may be unitarily formed from one cardboard blank.

Each of the primary packages may be a blister package. The blister package may comprise a blister layer being attached onto a cardboard blank and having a transparent blister cavity. Therefore, at least a portion of the product stored in the cavity may be visible through the aperture provided in the front panel of the secondary package.

The back panel of the secondary package may comprise at least one aperture allowing visual inspection of at least a portion of one or several primary packages. Said aperture provided in the back panel may be covered with a transparent foil or transparent plastic layer to protect the primary packages. Both, the cardboard blanks of the primary blister packages and the back panel of the secondary package may comprise overlapping portions through which the products are at least partially visible, for example by means of apertures which may be covered with transparent foils or transparent plastic layers to protect the products stored in the package kit. For example, in case the products are oral care implements, like manual toothbrushes or refills for electrical toothbrushes, the heads of such oral care implements may be visible allowing visual inspection of specific features of the products, e.g. a tongue cleaner arranged on the backside of the head, i.e. on the side opposing the bristle bearing face. Alternatively, the overall oral care implement may be visible through one or a plurality of apertures which may be covered by transparent foils or transparent plastic layers.

The cardboard blanks of the primary blister packages may be single- or multi-layer cardboard blanks. The cardboard blanks may have a weight of from about 250 $g/m^2$ to about 600 $g/m^2$, optionally of from about 300 $g/m^2$ to about 500 $g/m^2$, further optionally of about 400 $g/m^2$. A cardboard weight of about 400 $g/m^2$ may provide sufficient stability to the blister packages.

The package kit may have a length extension of from about 200 mm to about 350 mm, optionally of from about 250 mm to about 320 mm, further optionally of about 302 mm, a width extension of from about 200 mm to about 350 mm, optionally of from about 250 mm to about 300 mm, further optionally of about 275 mm, and a height extension of from about 10 mm to about 40 mm, optionally of from about 20 mm to about 30 mm, further optionally of about 27 mm.

A process for the manufacture of the primary packages comprises the following steps:

providing a plurality of plastic sheets, inserting the plastic sheets into molds, each mold having a mold cavity, heating the plastic sheets to a forming temperature in order to be pliable, thermoforming a cavity into each plastic sheet, the cavity corresponding to the shape of the mold cavity, thereby providing a blister layer comprising a blister cavity, providing a plurality of products, inserting the products into the respective blister cavities, providing a plurality of cardboard blanks, attaching the cardboard blanks onto the blister layers, thereby providing a plurality of primary packages, each package comprising a product.

The plastic sheet may be a PET plastic sheet. Further, the cardboard blank may be attached/connected to the blister layer by means of hot or cold sealing, adhesive tape application, adhesive and/or glue.

After the cardboard blank is attached onto the blister layer, the process may further comprise the step of die-cutting the outer circumferential rim of each primary package to a desired contour.

The process for the manufacture of the secondary package comprising the primary package and the products, thereby forming a package product arrangement, comprises the following steps:

providing a front panel in a substantially flat manner, the front panel comprising at least a first row of a plurality of apertures, the number of apertures corresponding to the number of primary packages, at least a first outer circumferential portion partially surrounding the plurality of apertures, a second outer circumferential portion, and a portion being arranged between the first and the second outer circumferential portion, folding the front panel in a manner that the portion is elevated with respect to the first and second outer circumferential portions, and forms an inner recess, laying the primary packages onto the front panel so that the respective blister cavities are placed in the recess, and each cavity extend at least partially through the respective aperture, providing a back panel, and attaching the back panel to at least a portion of the first outer circumferential portion and to at least a portion of the second outer circumferential portion, thereby providing a secondary package comprising a plurality of primary packages and the products.

The back panel may be attached/connected to the front panel by means of hot or cold sealing, adhesive tape application, adhesive and/or glue.

The front panel may be slightly larger in the width extension and/or in the length extension than the back panel. In other words, the front panel may slightly overlap/project over the back panel in order to adjust/balance variations in positioning the back panel onto the front panel. Further, this may ensure that the back panel is not visible when the package-product arrangement is seen from a top-down view, e.g. when the back panel is less attractive than the front panel. For example, the front panel may have a length extension and/or a width extension being from about 0.3 mm to about 1 mm larger than the respective extensions of the back panel.

The following is a non-limiting discussion of example embodiments of a package kit and a package-product arrangement in accordance with the present disclosure, where reference to the Figures is made.

Figure 2:
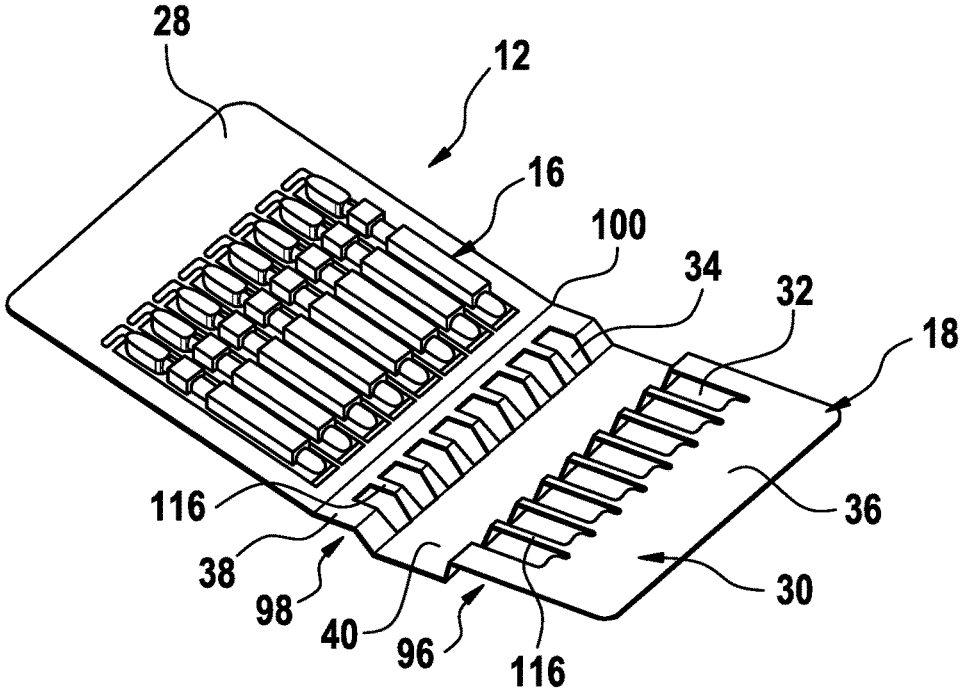
FIG. 2 shows a schematic perspective view of the package kit of FIG. 1 in an open position.
Figure 4:
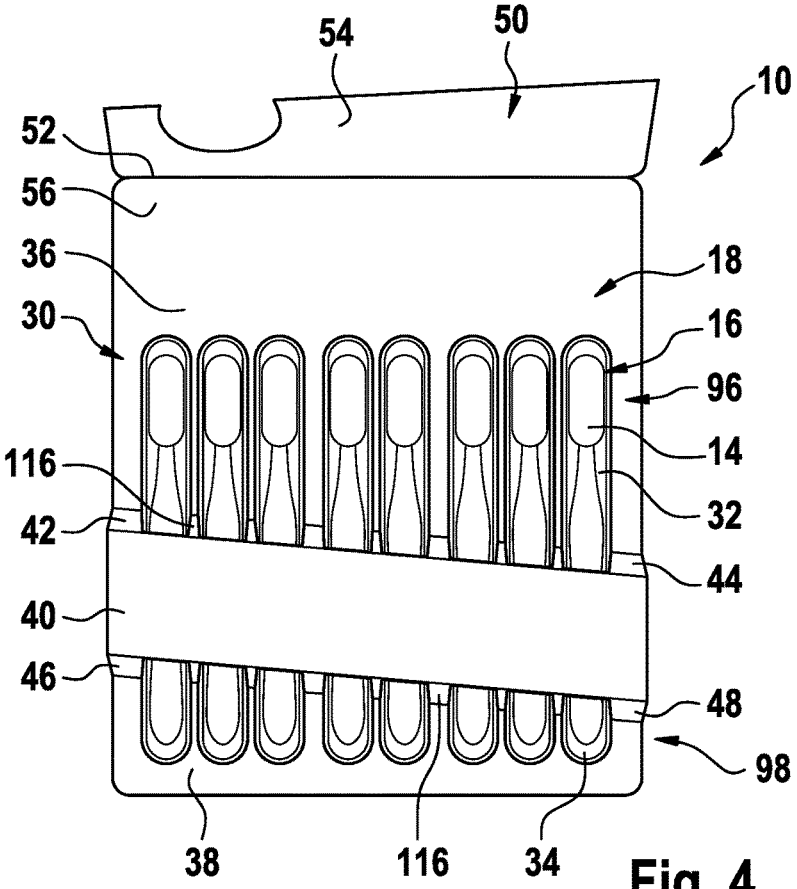
FIG. 4 shows a schematic perspective view of an embodiment of a product-package arrangement comprising a flap in an open position.
Figure 7:
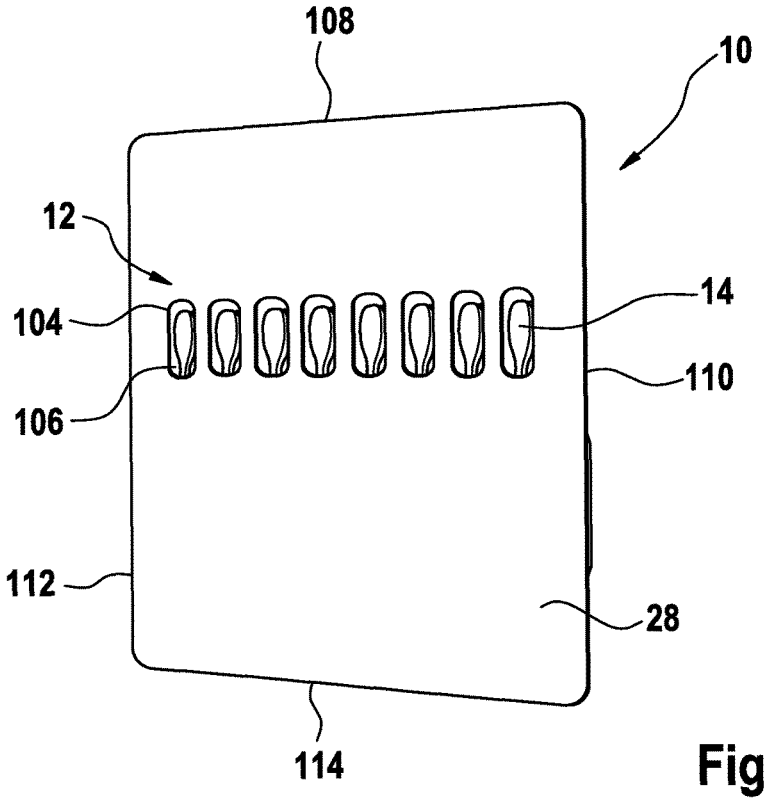
FIG. 7 shows a schematic back view of the product-package arrangement of FIG. 4 comprising the primary package embodiment of FIG. 6.

FIGS. 1 and 2 show a package kit 12 for storing a plurality of products 14. A package-product arrangement 10 comprising a package kit 12 and a plurality of products 14 is shown in FIGS. 4 and 7. The products 14 stored in the package-product arrangement 10 are manual toothbrushes 14, although other products can be stored in the package kit 12, as well, for example other consumer goods, e.g. refills for electrical toothbrushes.

Figure 5:
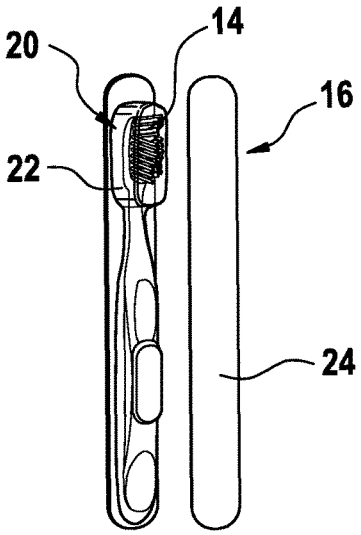
FIG. 5 shows a schematic perspective view as well as a back view of a primary package embodiment.
Figure 6:
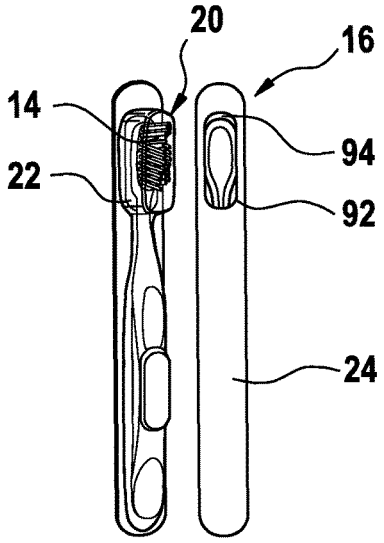
FIG. 6 shows a schematic perspective view as well as a back view of another primary package embodiment.

The package kit 12 comprises a plurality of primary packages 16, and an outer secondary package 18 in which the plurality of primary packages 16 are stored. As shown in the perspective and back views of FIGS. 5 and 6, each primary package 16 is a blister package 16 comprising a blister layer 22 with a blister cavity 20 for individually receiving a product 14. A cardboard blank 24 is attached to the backside of the blister layer 22 to seal the primary package 16. The primary package embodiment 16 as shown in FIG. 5 comprises a cardboard blank 24 without any apertures or cut-out windows, while the cardboard blank 24 of the primary package embodiment 16 as shown in FIG. 6 comprises a cut-out window 92 being covered with a transparent foil 94 or transparent plastic layer 94 to display and protect the product 14 stored in the primary package 16.

The secondary package 18 comprises a back panel 28 and a front panel 30 between which the primary packages 16 are sandwiched when the package kit 12 is in its closed position (cf. FIG. 1). The front panel 30 comprises a first row 96 of a plurality of apertures 32 and a second row 98 of a plurality of apertures 34. The numbers of apertures 32, 34 of the first and the second row 96, 98 correspond to the number of primary packages 16, and the apertures 32, 34 are arranged in a manner that each primary package 16 is at least partially visible through the respective apertures 32, 34. A first outer circumferential portion 36 partially surrounds the apertures 32 of the first row 96 and is partially attached to the back panel 28, while a second outer circumferential portion 38 partially surrounds the apertures 34 of the second row 98 and is partially attached to the back panel 28, as well, to retain the primary packages 16 in the secondary outer package 18. The first circumferential portion 36 is placed along the upper lateral edge 108 and along a portion of both opposed lateral edges 110, 112 along the length extension 64 of the package kit 12, while the second circumferential portion 38 is placed along the lower lateral edge 114 and along a portion of both opposed lateral edges 110, 112 along the length extension 64 of the package kit 12.

The front panel 30 further comprises an elevated portion 40 arranged between the first and the second row 96, 98 of apertures 32, 34, as well as between the first and the second outer circumferential portion 36, 38. The elevated portion 40 is more elevated than any other portion of the secondary package 18 when seen in a side view. The elevated portion 40 extends from a first limb 42, a second limb 44, a third limb 46 and a fourth limb 48 in a hingeable manner so that the elevated portion 40 is provided with some flexibility to move/bend slightly in opposite directions. Said limbs 42, 44, 46, 48 are hingeably connected portions of the first and the second outer circumferential portion 36, 38, and extend in a direction away from the back panel 28, thereby providing an inner recess 58 between the elevated portion 40 and the back panel 28 (cf. FIG. 1).

Between each neighboring apertures 32, 34 of the first row as well as of the second row 96, 98 a web 116 is provided. The webs 116 between the apertures 32 of the first row 96 extend between the first outer circumferential portion 36 and the elevated portion 40, while the webs 116 between the apertures 34 of the second row 98 extend between the second outer circumferential portion 38 and the elevated portion 40 to provide the package kit with increased stability.

Figure 3:
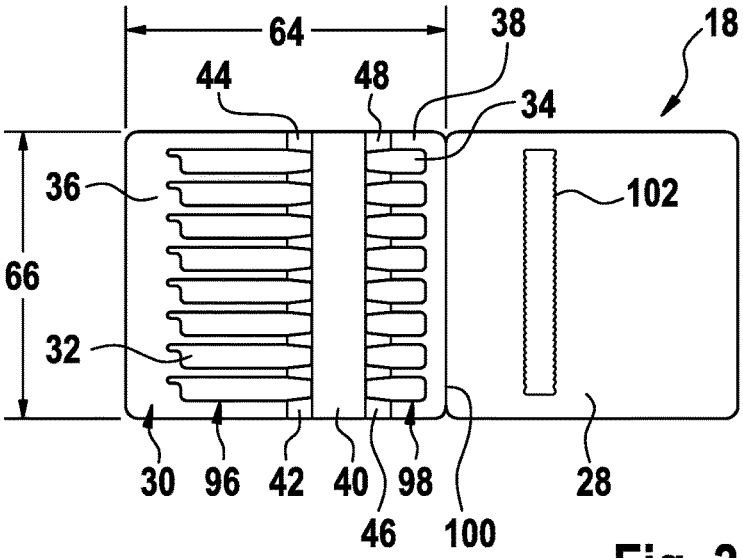
FIG. 3 shows a top down view of the secondary package of the package kit of FIG. 1 in an open position.

As shown in FIGS. 2 and 3, the front panel 30 and the back panel 28 may be unitarily formed from one piece of cardboard blank and are hingeably connected via a crease, a perforation or a folding line 100. Alternatively, the front panel 30 and the back panel 28 can be formed from two separate cardboard blanks 30, 28.

As shown in FIG. 3, the back panel 28 of the secondary package 18 may comprise a perforation zone 102, e.g. a perforation line to facilitate opening the secondary package 18 by tearing/cutting along said perforation line 102.

In the package-product arrangement 10 of FIG. 4, the secondary package 18 stores a plurality of primary packages 16 as shown in FIG. 6. The secondary package 18 further comprises a flap 50 hingeably connected to an upper lateral edge 52 of the first outer circumferential portion 36 of the front panel 30. The flap 50 provides space for printing/displaying artwork and/or information. The hingeable connection allows the flap 50 to be turned upwards in an open position or downwards, i.e. onto and in alignment with the front panel 30. In case artwork and/or information is printed onto the inner surface 54 of the flap 50 facing the upper surface 56 of the front panel 30, information can be hided at the point of sale, for example, by flapping the flap 50 onto the front panel 30. Before a product 14 is taken out of the package-product arrangement 10, the consumer may turn the flap 50 in an open/upward position to read the respective information. The flap 50 and the front panel 30 are unitarily formed from one cardboard blank.

As shown in FIG. 7, the back panel 28 of the secondary package 18 of the product-package arrangement 10 of FIG. 4 comprises a plurality of cut-out windows 104 which overlap with the cut-out windows 92 of the primary packages 16 of FIG. 5 to display a portion of the products 14. Said cut-out windows 104 may be covered with a transparent foil 106 or transparent plastic layer 106 to protect the primary packages 16.

The package-product arrangement 10 may have a length extension 64 of from about 200 mm to about 350 mm, optionally of from about 250 mm to about 320 mm, further optionally of about 302 mm, a width extension 66 of from about 200 mm to about 350 mm, optionally of from about 250 mm to about 300 mm, further optionally of about 275 mm, and a height extension 68 of from about 10 mm to about 40 mm, optionally of from about 20 mm to about 30 mm, further optionally of about 27 mm (cf. FIGS. 1 and 3).

In the present context, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

What is claimed is:

1. A package kit for storing a plurality of products, the package kit comprising:

a plurality of primary packages, each primary package comprising a cavity for storing one of the products, and a secondary package storing the plurality of primary packages, the secondary package comprising a back panel and a front panel, the plurality of primary packages being sandwiched between the back panel and the front panel, the front panel comprising at least a first row of a plurality of apertures, the number of apertures corresponding to the number of primary packages for displaying at least a portion of each primary package, at least a first outer circumferential portion partially surrounding the plurality of apertures and being at least partially attached to the back panel, and a second outer circumferential portion being at least partially attached to the back panel, wherein the front panel further comprises an elevated portion being arranged between the first outer circumferential portion and the second outer circumferential portion, wherein the first outer circumferential portion comprises a first limb and a second limb, and the second outer circumferential portion comprises a third limb and a fourth limb, and the elevated portion extends from the first, the second, the third and the fourth limb, respectively, wherein the elevated portion is hingeably connected to the first, the second, the third and the fourth limb, respectively.

2. A package kit according to claim 1, wherein the front panel comprises a second row of a plurality of apertures, the number of apertures corresponding to the number of primary packages for displaying at least a further portion of each primary package, and the second outer circumferential portion partially surrounds the plurality of apertures of the second row.

3. A package kit according to claim 1, wherein the first limb and the second limb are hingeably connected to the first outer circumferential portion, and the third limb and the fourth limb are hingeably connected to the second outer circumferential portion.

4. A package kit according to claim 1, wherein at least one of the front panel and the back panel is unitarily formed from a cardboard blank.

5. A package kit according to claim 4, wherein the front panel and the back panel are unitarily formed from one cardboard blank.

6. A package kit according to claim 1, wherein the front panel and the back panel are formed from two separate cardboard blanks, and the weight of the cardboard blank of the front panel is different from the weight of the cardboard blank of the back panel.

7. A package kit according to claim 1, wherein the secondary package comprises a flap hingeably connected to at least one of a lateral edge of the first or second outer circumferential portion of the front panel or hingeably connected to a lateral edge of the back panel.

8. A package kit according to claim 1, wherein each of the primary packages is a blister package.

9. A package kit according to claim 8, wherein the blister package comprises a cardboard blank onto which a blister layer is attached, the blister layer comprising a blister cavity for storing a product.

10. A package-product arrangement comprising a package kit according to claim 1 and a plurality of products.

11. A package-product arrangement according to claim 10, wherein at least one of the products is an oral care implement.

12. A package-product arrangement according to claim 11, wherein at least one of the products is a brush head for an electrical toothbrush.

13. A process for the manufacture of a package-product arrangement according to claim 10, comprising the following steps:

providing a plurality of plastic sheets, inserting the plastic sheets into molds, each mold having a mold cavity, heating the plastic sheets to a forming temperature in order to be pliable, thermoforming a cavity into each plastic sheet, the cavity corresponding to the shape of the mold cavity, thereby providing a blister layer comprising a blister cavity, providing a plurality of products, inserting the products into the respective blister cavities, providing a plurality of cardboard blanks, attaching the cardboard blanks onto the blister layers, thereby providing a plurality of primary packages, each package comprising a product, providing a front panel in a substantially flat manner, the front panel comprising at least a first row of a plurality of apertures, the number of apertures corresponding to the number of primary packages, at least a first outer circumferential portion partially surrounding the plurality of apertures, a second outer circumferential portion, and a portion being arranged between the first and the second outer circumferential portion, folding the front panel in a manner that the portion is elevated with respect to the first and second outer circumferential portions, and forms an inner recess, laying the primary packages onto the front panel so that the blister cavities are placed in the recess, and each cavity extend at least partially through the respective aperture, providing a back panel, and attaching the back panel to at least a portion of the first outer circumferential portion and to at least a portion of the second outer circumferential portion, thereby providing a secondary package comprising a plurality of primary packages and the products.

14. A package-product arrangement produced by the process of claim 13.

* * * * *